US006120214A

United States Patent [19]

Iovino

[11] Patent Number: 6,120,214

[45] Date of Patent: Sep. 19, 2000

[54] PROCESS FOR CONSTRUCTING REINFORCED SUBTERRANEAN COLUMNS

[75] Inventor: Pier Iovino, Mashpee, Mass.

[73] Assignee: Layne Christensen Company, Mission Woods, Kans.

[21] Appl. No.: 09/234,353

[22] Filed: Jan. 20, 1999

[51] Int. Cl.[7] ..... E02D 5/56; E02D 5/18

[52] U.S. Cl. ..... 405/241; 405/240; 405/248; 405/269

[58] Field of Search ..... 405/240–243, 405/236, 237, 269, 248, 233

[56] References Cited

U.S. PATENT DOCUMENTS

| | | | |
|---|---|---|---|
| 1,654,600 | 1/1928 | Powell | 405/240 |
| 3,195,311 | 7/1965 | Degen . | |
| 3,391,544 | 7/1968 | Daczko | 405/241 |
| 3,499,293 | 3/1970 | Kato | 405/241 |
| 3,504,497 | 4/1970 | Turzillo . | |
| 3,512,366 | 5/1970 | Turzillo | 405/241 |
| 3,707,848 | 1/1973 | Chelminski | 405/240 X |
| 3,802,203 | 4/1974 | Ichise et al. . | |
| 3,839,875 | 10/1974 | Matsushita | 405/248 |
| 3,969,902 | 7/1976 | Ichise et al. . | |
| 4,084,648 | 4/1978 | Yahiro et al. . | |
| 4,640,649 | 2/1987 | Nakanishi | 405/233 X |
| 4,832,535 | 5/1989 | Crambes . | |
| 4,958,962 | 9/1990 | Schellhorn . | |
| 5,141,366 | 8/1992 | Ishida et al. | 405/269 X |
| 5,304,016 | 4/1994 | Kunito . | |
| 5,542,786 | 8/1996 | Blum | 405/241 X |
| 5,624,209 | 4/1997 | Melegari | 405/269 |

*Primary Examiner*—Dennis L. Taylor
*Attorney, Agent, or Firm*—Shook, Hardy & Bacon LLP

[57] ABSTRACT

A process for constructing a jet grouted subterranean column provided with reinforcement. A hole is drilled in the ground to the desired depth using a drill bit carried in a hollow drill rod to which a drill casing is detachably coupled. As the drilling proceeds, grout is applied through the drill rod and is injected sidewardly at high pressure to cut into and mix with the bore wall. The casing is detached from the drill rod and lowered to the bottom of the bore, with the grout filling the annular space between the casing and enlarged bore wall. After the drill rod has been withdrawn from the casing, the casing may be left in place and filled with grout such that the casing provides reinforcement for the resulting grout column. Additional reinforcing material may be inserted through the casing. In an alternative process carried out in accordance with the invention, a bore is drilled with a special drill rod and a sacrificial drill bit. After the drilling has been completed, the drill rod is rotated and grout is applied through it at high pressure. The wall of the rod has axially and circumferentially staggered discharge openings through which the grout is injected to enlarge and fill the bore. The drill rod is left in place centered in the bore to structurally reinforce the grout column.

19 Claims, 2 Drawing Sheets

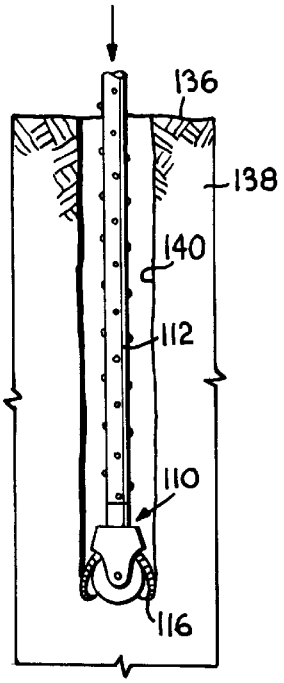
Fig. 8.
Fig. 9.
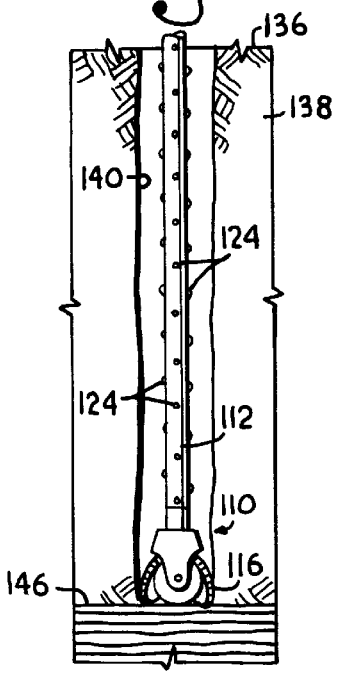
Fig. 10.
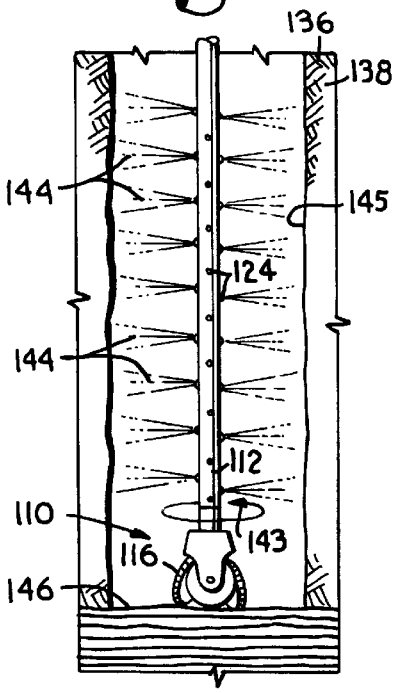
Fig. 11.
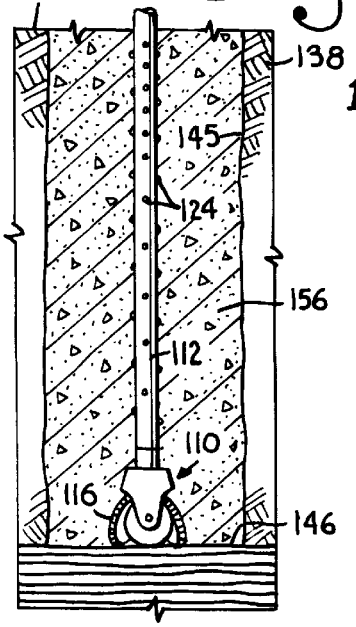
Fig. 12.
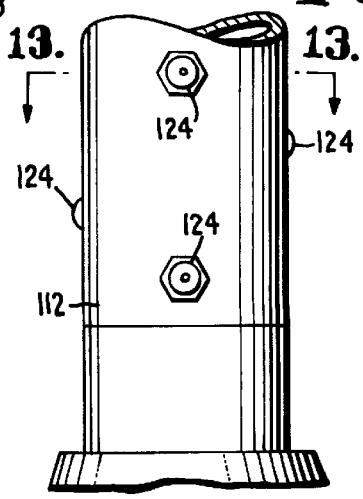
Fig. 13.
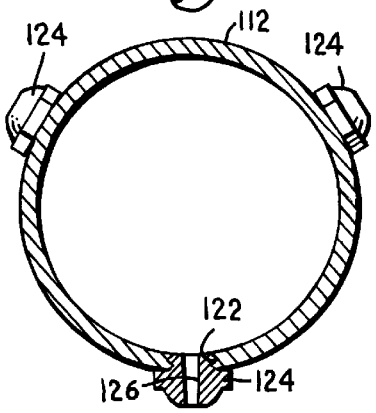

PROCESS FOR CONSTRUCTING REINFORCED SUBTERRANEAN COLUMNS

FIELD OF THE INVENTION

This invention relates in general to the construction of jet grouted columns and deals more particularly with a process for constructing subterranean columns using high pressure grouting methods and unique techniques for structurally reinforcing the columns.

BACKGROUND OF THE INVENTION

Construction methods using jet grouting have been used in a variety of applications where structural strengthening or reinforcement of the earth is required. For example, jet grouting has been applied to build structures used for underpinnings, landslide stabilization, earth tie-downs, earth anchors, embankment consolidation and excavation support for tunnels and above ground structures.

Jet grouting generally makes use of high pressures on the order of 6,000–8,000 psi to inject cementitious grout fluids into the soil at high velocities. A typical application involves drilling or otherwise forming a bore and then injecting grout at high pressure into the walls of the bore to cut into and mix with the soil and other native materials around the bore. After the grout has been allowed to harden, a column is formed in the bore and the soil immediately surrounding it. The column can be used as structural support for a building or other structure erected on previously unstable soil. One of the principal advantages of the jet grouting process is that a relatively large diameter column can be formed with only a relatively small diameter bore required. The high injection pressure of the grout carries it well into the soil around the drilled hole. In this manner, the grouting pressure effectively increases the bore size and results in a large and strong column. At the same time, drilling costs are incurred for only a relatively small diameter hole.

Using reinforcing bar and other reinforcement materials in subterranean columns of this type is known to increase the column strength markedly. However, the application of reinforcing materials has been difficult to accomplish from a practical standpoint. Typically, a number of additional steps in the construction process are required, and they can result in significantly increased costs due to delay, labor costs, and the need for additional equipment to install the reinforcing elements. Accurate placement of the reinforcement in the column has also been a problem. If the reinforcement is improperly positioned, the reinforcing effect is reduced accordingly.

SUMMARY OF THE INVENTION

The present invention is directed to a novel process for constructing a jet grouted column which includes structurally reinforcing the column without significantly complicating the construction process. It is the principal object of the invention to provide an economical process by which a reinforced jet grouted column can be constructed at a subterranean location in a simple manner and with reinforcement embedded in the column and placed accurately to offer maximum strength.

In accordance with one technique embodying the invention, a drill rod and a hollow casing are coupled together and advanced together into the ground to drill a bore to the desired depth. Cementitious grout is injected at high pressure through the drill rod and is discharged into the bore in a sidewardly direction at a location below the open lower end of the casing. The grout penetrates the bore walls and forms a column structure in the bore outside of the casing.

When the desired bore depth is reached, the casing is located on the bottom of the bore and the drill rod is withdrawn. Additional grout can be pumped or otherwise applied into the casing to fill its interior. After the grout has set, the casing is embedded in the column and is centered therein to provide the column with a symmetrically arranged reinforcing element.

DESCRIPTION OF THE DRAWINGS

In the accompanying drawings:

FIG. 8 is a diagrammatic elevational view showing a drill assembly having a drill rod equipped with radial nozzles being advanced into the ground to form a bore in accordance with an alternative process of the present invention;

FIG. 9 is a diagrammatic elevational view similar to FIG. 8, but showing the bore drilled to its final depth;

FIG. 10 is a diagrammatic elevational view similar to FIGS. 8 and 9, showing grout being injected at high pressure and the drill rod being rotated to apply the grout radially to fill and enlarge the bore;

FIG. 11 is a diagrammatic elevational view similar to FIGS. 8–10 showing a completed grout column constructed according to the alternative process of the invention;

FIG. 12 is a fragmentary elevational view on an enlarged scale of the drill rod used in the process of FIGS. 8–10; and FIG. 13 is a fragmentary sectional view on an enlarged scale taken generally along line 13—13 of FIG. 12 in the direction of the arrows.

DETAILED DESCRIPTION OF THE INVENTION

Figures 1, 2, 3, 4, 5, 6, 7:
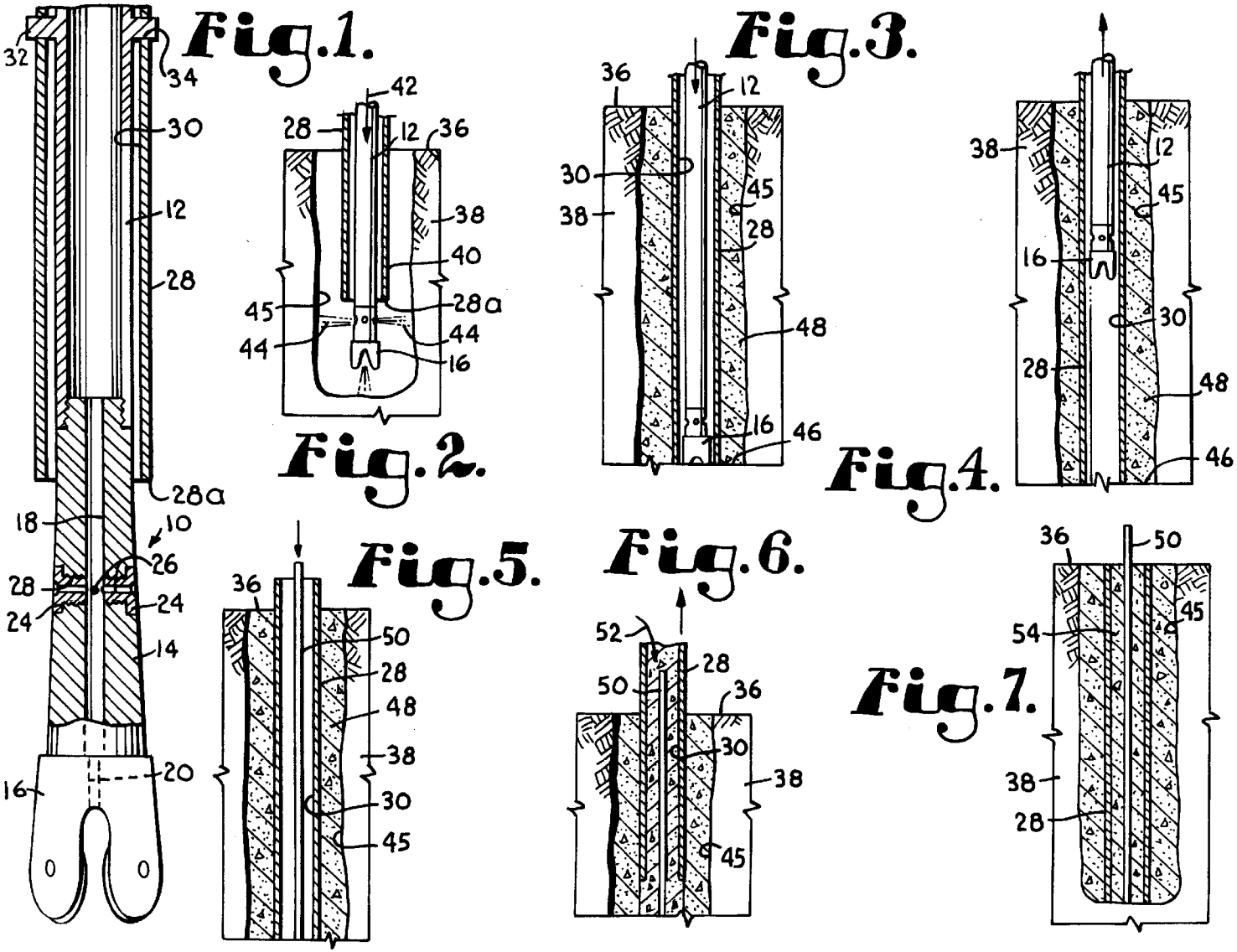
FIG. 1 is a fragmentary elevational view, partially in cross-section, diagrammatically showing a drill assembly and casing that may be used to construct reinforced jet grouted columns in accordance with one construction process of the present invention.
FIG. 2 is a diagrammatic elevational view showing the drill assembly and casing being advanced into the ground to drill a bore and to simultaneously apply grout under high pressures in accordance with one process of the invention.
FIG. 3 is a diagrammatic elevational view similar to FIG. 2, but showing the completion of the drilling operation and the casing lowered to the bottom of the bore.
FIG. 4 is a diagrammatic elevational view similar to FIGS. 2–3, but showing the drill assembly being extracted from the bore and casing.
FIG. 5 is a diagrammatic elevational view similar to FIGS. 2–4, showing the drill assembly completely withdrawn and a reinforcing rod installed in the bore through the center of the casing.
FIG. 6 is a diagrammatic elevational view similar to FIGS. 2–5, but showing the casing being withdrawn from the bore and grout being applied into the center portion of the bore through the casing as it is being withdrawn.
FIG. 7 is a diagrammatic elevational view similar to FIGS. 2–6, but showing a completed subterranean column reinforced by leaving the casing embedded in the column in accordance with the invention.

Referring now to the drawings in more detail and initially to FIG. 1, a drill assembly of the type which may be used for the construction of reinforced jet grouted columns in accordance with one aspect of the present invention is generally identified by numeral 10. The drill assembly 10 includes a hollow drill rod 12 which takes the form of a hollow pipe which may be rotated to advance the drill assembly into the soil. A barrel 14 is carried on the lower end of the drill rod 12 and provides a monitor or tooling adapter that flares slightly from top to bottom. The barrel 14 may be threaded or otherwise connected to the lower end of the drill rod 12. The barrel 14 carries on its lower end a drill bit 16 which may be connected with the barrel in any suitable way and which functions to cut and remove ground materials. The drill bit 16 may operate conventionally with a water or compressed air flush drilling method to drill the hole to the desired depth.

As previously indicated, the drill rod 12 is a hollow pipe through which fluids can be applied. The barrel 14 has a central axial passage 18 which connects at its upper end with the interior of the drill rod 12 and at its lower end with a passage 20 formed in the drill bit 16. The passage 20 may be provided with a conventional check valve (not shown) which allows grout to be applied to the passage 18 at high pressures, as will be explained more fully.

A plurality of radial ports 22 are formed in the barrel 14 at circumferentially spaced locations around its perimeter. The ports 22 extend from the outside surface of the barrel 14 to connection with the axial passage 18. The ports 22 are internally threaded in order to receive externally threaded injection nozzles 24 which are secured in the ports 22 and which are constructed to inject a water-Portland cement grout mixture at pressures that may approach 12,000 psi. Each of the injection nozzles 24 has a central injection passage 26 through which the grout is injected. The passages 26 are oriented radially relative to the longitudinal axis of the drill rod 12 such that the grout which is applied through the passages 26 is injected sidewardly.

A drill casing 28 is used in conjunction with the drill assembly 10. The casing 28 may be a hollow metal pipe having an inside diameter slightly greater than the maximum outside diameter of the drill bit 16. The interior of the casing 28 presents an open cavity 30.

The casing 28 is detachably coupled to the drill rod 12 so that the casing is advanced with the drill rod into the hole which is being drilled. A plurality of retractable pins 32 may be formed on the drill rod 12 to extend through openings 24 formed in the casing 28 in order to couple the casing and drill rod together. The pins 32 may be retracted to remove them from the openings 32 so that the drill rod can be uncoupled from the casing for a purpose that will be explained in more detail. As an alternative to the retractable pins 32 and openings 34, other types of detachable coupling means may be employed to couple the casing with the drill rod in a manner allowing these components to be uncoupled as desired. The casing 28 has a lower end 28*a* which is located slightly above the injection nozzles 24 when the casing and drill rod are coupled together.

FIGS. 2–7 show sequentially the steps which may be carried out to construct a jet grouted column in accordance with the present invention. Referring initially to FIG. 2, numeral 36 identifies the surface of the soil 38 in which a subterranean jet grouted column is to be constructed. The drill assembly 10 is advanced into the soil 38 from the surface 36 using conventional drilling techniques in order to form a bore 40 which is drilled to the diameter of the drill bit 16. Because the casing 28 is coupled with the drill rod 12, the casing is advanced into the ground along with the drill assembly.

As the drilling operation proceeds, grout is injected through the drill rod 12 under high pressure, as indicated by the directional arrow 44 in FIG. 2. The high pressure grout is applied through the drill rod 12 and into the passage 18 in barrel 14. The check valve (not shown) in the drill bit passage 20 closes in response to the high pressure application of the grout through passage 18. The grout that is applied to passage 18 is injected sidewardly through the nozzles 24, as indicated at 44 in FIG. 2. Because the nozzles 24 are located below the lower end 28*a* of the casing 28, the grout injection takes place a short distance below the casing end 28*a*.

The grout is injected at pressures which are typically in the range of about 6,000–8,000 psi and which may approach 12,000 psi. The grout is injected through the nozzle passages 26 at velocities that are typically about 800–1,000 feet per second. This high velocity injection of the grout fluid as indicated at 44 causes the grout to penetrate the walls of the drilled hole and to cut, replace, and/or mix with the soil 38 (or other native materials) around the hole. The drilled hole is thus enlarged by the grout injection to the size depicted for the bore 45.

The grout injection takes place simultaneously with the drilling operation such that it proceeds as the drilling rod 12 and casing 28 are advanced into the bore 40. Because the injection nozzles 24 are located only slightly below the bottom end 28*a* of casing 28, and because the casing 28 is advanced into the bore as the drilling operation proceeds, the grout 44 is applied to the entirety of the bore except for that part of the bore that is occupied by the casing 28.

The drilling and jet grouting operations continue simultaneously in this manner until the bore has been drilled to the desired depth. At that point, the drill bit 16 is at the floor 46 of the bore. The drilling rod 12 and casing 28 are uncoupled from one another, such as by retracting the pins 32, and the casing 28 is lowered onto the floor 46. As shown in FIG. 3, the casing extends continuously through the center of the bore to a location at or above the surface level 36. The grout which has been injected at high pressure substantially fills the bore 45 in the annular space 48 (FIG. 3) which is outside of the casing 28.

With reference to FIG. 4, the drilling assembly 10 is then withdrawn from the bore 40 by pulling it upwardly through the casing 28 to a location above the surface 36. The casing 28 remains in the bore 45 and rests on its floor 46.

After the drilling assembly 10 has been withdrawn, reinforcement may be applied through the interior 30 of casing 28. As shown in FIG. 5, the reinforcing can take the form of a steel reinforcing bar or rod 50 which is applied along the longitudinal axis of the casing 28. The bottom end of the reinforcing rod 50 may be driven into the floor 46 of the bore in order to secure it properly in place centered in the casing and the bore.

It should be understood that reinforcing materials other than a single reinforcing rod 50 may be employed. By way of example, the reinforcement can include multiple metal bars, steel or plastic materials of various types, wire strands, fiberglass materials, and/or other construction materials known to have effective characteristics as reinforcement for cementitious grout. The interior 30 of the casing provides a space for installation of any of these types of reinforcement materials.

After the reinforcement has been installed, the casing 28 may be withdrawn from the bore, and additional grout is pumped, poured or otherwise applied to the bore through the casing 28, as indicated by the directional arrow 52 in FIG.

6. The additional grout is applied through the casing 28 as the casing is being withdrawn from the bore and is thus applied in a manner to fill the void that was formerly occupied by the casing 28. It is noted that the additional grout is applied around the reinforcing rod 50 (or other reinforcement applied to the center area of the bore through the casing).

The grout that is applied through the casing is applied continuously as the casing is withdrawn until the lower end 28*a* of the casing has reached the surface 36. At that time, the bore 40 has been completely filled with grout, and the reinforcing rod 50 is embedded in the grout at the center of the bore. As shown in FIG. 7, the result is a subterranean grout column 54 which completely fills the bore 45 and embeds the reinforcing rod 50 at the center of the column 54 in extension along the longitudinal axis of the column. As a result, the reinforcing rod 50 is accurately placed at the center of the column where its reinforcing effect is maximized.

As an alternative to the placement of additional reinforcing material such as the reinforcing rod 50 into the bore, the steel casing 28 can be left in place in the bore to provide reinforcement for the subterranean grout column, alone or together with the rod 50 (or other reinforcement) as shown in FIG. 7. In the case where only the casing 28 provides reinforcement, after the drilling assembly 10 has been completely withdrawn following the step depicted in FIG. 4, additional grout is simply poured or pumped through the interior 30 of casing 28 to completely fill the casing while the casing remains in place resting on the bottom 46 of the bore 40. After the grout has set up, the grout column is completed, and the steel casing 28 is embedded in the grout column at a symmetrically located position in the column in order to provide effective structural reinforcement for the column.

In an alternative construction process carried out in accordance with the invention, a bore is drilled using a special drill rod having radial nozzles. Once the desired depth has been reached, high pressure grout is injected through the drill rod to enlarge the bore and fill it with grout. The drill rod remains in place centered in the bore and provides structural reinforcement for the jet grouted column.

It should be noted that the casing 28 can be left in place to serve as reinforcement and that additional reinforcing materials such as the reinforcing rod 50 can be applied in addition to the casing. Thus, the process of the present invention accommodates the application of reinforcing material as necessary to provide the type and extent of reinforcement that is applicable to whatever purpose the subterranean column is to serve.

FIGS. 8–11 depict an alternative construction process carried out in accordance with the present invention. A drill assembly generally identified by numeral 110 includes a drill rod 112 which may take the form of a hollow pipe that may be rotated to advance the drill assembly into the soil. The drill rod 112 carries on its lower end a drill bit 116 which is a sacrificial bit. The bit 116 may operate conventionally with a water or compressed air flush drilling method to drill the hole to the desired depth.

As best shown in FIGS. 12 and 13, the drill rod 116 is provided with a plurality of side ports 122 (FIG. 13) which are used to apply grout radially from rod 116 under high pressure. The ports 122 are internally threaded to receive threaded injection nozzles 124 which are constructed to inject a water-Portland cement grout mixture at pressures up to about 12,000 psi. Each nozzle 124 has a central injection passage 126 through which the grout is injected. The passages 126 are oriented radially relative to the longitudinal axis of the drill rod 112 such that the grout is injected sidewardly or radially.

With continued reference to FIGS. 12 and 13 in particular, the nozzles 124 are staggered around the circumference of the drill rod 116 at 120° degree increments. Also, the nozzles 124 are staggered along the length of the drill rod such that each nozzle is spaced from each adjacent nozzle a distance of approximately 5–6 inches measured longitudinally along rod 112. Thus, the nozzles are preferably all located along a spiral line extending around and along the drill rod 112.

FIGS. 8–11 show sequentially the steps which may be followed to construct a jet grouted column in accordance with the present invention. First, the drill assembly 110 is advanced into the surface 136 of the soil 138 to form a bore 140. Conventional drilling techniques are used. The bore 140 has the same diameter as the drill bit 116.

FIG. 9 depicts the drill assembly 110 advanced to the desired depth of the bore 140, with the bit 116 located at the bottom 1465 of the bore. At this time, the drill rod 112 is rotated (see directional arrows 143 of FIG. 10) and grout is injected at high pressure through the drill rod 112 (see FIG. 10). As the rod rotates, the high pressure grout is discharged radially through the nozzles 124, as indicated at 144 in FIG. 10. The grout is injected at pressures that are typically in the range of 6000–8000 psi and may approach 12,000 psi. The velocity of the grout discharging through the nozzle passages 126 may be 800–1000 feet per second. The high pressure grout penetrates the walls of the bore 40 and cuts, replaces and/or mixes with the adjacent soil 138 or other native material near the bore. The bore is thus enlarged by the grout injection to the size indicated by numeral 145 in FIG. 10.

The rotation of the drill rod 112 during grout injection and the staggered circumferential and axial locations of the injection nozzles 124 results in a bore 145 that is enlarged through its entire depth in a relatively uniform manner (if the surrounding materials are relatively uniform). In any event, the bore 145 is substantially larger than the drilled bore 140. The entire volume of the bore 145 is filled with grout at the end of the jet grouting operation.

After the grout application is complete, the injection of grout is stopped, and the inside of the drill rod is filled with grout. The rod 112 and drill bit 116 are left in place. As shown in FIG. 11, the rod 112 is centered in the resulting subterranean grout column 156 and is embedded in the column to provide structural reinforcement. The bit 116 is sacrificial and remains at the bottom of the column 156. The rod 112 can be cut off at or near the surface 136.

The construction process shown in FIGS. 8–11 is particularly useful when the column 156 is to be used for applications requiring a strong and stable anchoring structure. It is also of considerable advantage in different drilling situations such as when hard rock structures are encountered. Typically, the drill rod 112 is used in sections each about 10 feet long. Often, in anchoring applications, a 10 feet deep hole is satisfactory, so a single pipe section may suffice although deeper holes and longer pipe are also common with this construction process.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A process for constructing a subterranean column comprising the steps of:

advancing into the ground a hollow casing and a hollow drill rod extending within the casing.

injecting grout at high pressure from said drill rod during advancement of the casing and rod to apply the grout outside of said casing into the bore formed by advancement of the drill rod;

withdrawing said drill rod from the bore and casing while maintaining said casing in the bore substantially centered therein to maintain an open cavity within the interior of said casing inside of the grout injected from said drill rod; and applying grout into said casing to substantially fill said cavity, thereby constructing a substantially solid column in the bore with said casing providing structural reinforcement of said grout.

2. A process as set forth in claim 1, including the step of:

installing a reinforcing element through the casing into said cavity prior to said step of applying grout into said casing.

3. A process as set forth in claim 2, wherein said step of installing a reinforcing element comprises installing said element at a location substantially centered on an axis of said cavity.

4. A process as set forth in claim 3, wherein said reinforcing element comprises a metal rod element.

5. A process for constructing a subterranean column comprising the steps of:

drilling a bore into the ground with a drill bit attached to a hollow drill rod which is substantially centered in a hollow casing advanced into the bore together with the drill rod as said drilling step is effected;

injecting grout from the surface at high pressure through said drill rod and out of the drill rod into the bore at a location below the casing, thereby forming a hollow column in the bore outside of the casing;

withdrawing the drill rod from the bore while maintaining the casing therein to maintain a cavity within the casing inside of the hollow column; and substantially filling said cavity by applying grout through the casing to complete the column.

6. A process as set forth in claim 5, including the step of:

installing a reinforcing element through the casing into said cavity prior to said step of substantially filling said cavity.

7. A process as set forth in claim 6, wherein said reinforcing element comprises a metal rod element.

8. A process as set forth in claim 6, wherein said step of installing a reinforcing element comprises installing said element at a location substantially centered on an axis of said cavity.

9. A process as set forth in claim 5, wherein said reinforcing element comprises a metal rod element.

10. A process for constructing a subterranean column comprising the steps of:

drilling a bore into the ground using a drill bit carried on a hollow drill rod;

injecting grout at high pressure through said drill rod and into the bore from the drill rod following said drilling step, said grout being injected in a manner to diametrically enlarge the bore and substantially fill the enlarged bore to construct a grout column in the enlarged bore; and leaving the drill rod and drill bit in the bore and embedded in said grout column to structurally reinforce said grout column.

11. A process as set forth in claim 10, wherein said grout is injected generally radially outwardly from said drill rod.

12. A process as set forth in claim 11, wherein said grout is injected at a plurality of locations spaced longitudinally along the length of said drill rod.

13. A process as set forth in claim 12, wherein said grout is injected at a plurality of locations spaced circumferentially around said drill rod.

14. A process as set forth in claim 11, wherein said grout is injected at a plurality of locations spaced circumferentially around said drill rod.

15. A process as set forth in claim 10, including the steps of rotating said drill rod during said injection step.

16. A process as set forth in claim 10, including the step of filling the inside of the drill rod with grout to apply grout to the center portion of said column.

17. A process for constructing a subterranean column comprising the steps of:

drilling a bore having a selected diameter using a drill bit carried on a hollow drill rod having a wall and a plurality of discharge openings in the wall spaced apart along the length of the drill rod;

applying grout at high pressure into the drill rod while axially rotating the drill rod to inject the grout radially outwardly at high pressure through said openings to enlarge the diameter of the bore beyond said selected diameter;

stopping the application of grout and the rotation of the drill rod when the enlarged diameter bore is substantially filled with grout to form the subterranean column; and leaving the drill rod in the bore to become embedded in the column for structural reinforcement thereof.

18. A process as set forth in claim 17, wherein said openings are arranged to be located on a spiral line extending around and along the drill rod.

19. A process as set forth in claim 17, wherein said openings are spaced apart circumferentially around the drill rod.

* * * * *